US005976675A

United States Patent [19]

Yamano et al.

[11] Patent Number: 5,976,675

[45] Date of Patent: Nov. 2, 1999

[54] PROCESS FOR PRODUCING THERMAL TRANSFER RECORDING MEDIUM HAVING NEAR END MARK

[75] Inventors: Tadamichi Yamano; Shinichi Ishikawa; Takao Arimura, all of Osaka, Japan

[73] Assignee: Fujicopian Co., Ltd., Osaka, Japan

[21] Appl. No.: 08/976,924

[22] Filed: Nov. 25, 1997

[51] Int. Cl.[6] ..... B41M 5/26

[52] U.S. Cl. ..... 428/195; 428/323; 428/484; 428/488.1; 428/913; 428/914

[58] Field of Search ..... 428/195, 323, 428/484, 488.1, 913, 914

[56] References Cited

U.S. PATENT DOCUMENTS 4,720,480 1/1988 Ito et al. ..... 503/227

*Primary Examiner*—Pamela R. Schwartz
*Attorney, Agent, or Firm*—Fish & Neave

[57] ABSTRACT

A process for producing a thermal transfer recording medium having a near end mark, which comprises: applying a near end mark ink onto the uppermost het-meltable layer of a thermal transfer recording medium and drying the resultant to form a near end mark, the near end mark ink being a white ink comprising a white pigment, a resin, a wax and a solvent, the white pigment comprising 40 to 60% by weight of the total amount of solid matters of the ink, the resin comprising at least one resin selected from the group consisting of terpene.phenol copolymer resin, phenol resin and polyethylene glycol resin, the wax comprising a particulate wax having an ester group and a melting point of not lower than 75° C., the solvent being capable of dissolving the resin and incapable of dissolving the particulate wax.

4 Claims, 1 Drawing Sheet

PROCESS FOR PRODUCING THERMAL TRANSFER RECORDING MEDIUM HAVING NEAR END MARK

BACKGROUND OF THE INVENTION

The present invention relates to a process for producing a thermal transfer recording medium having a near end mark. More particularly, it relates to a process for producing a thermal transfer recording medium which is characterized by the process of forming the near end mark.

Conventional thermal transfer recording media each have a near end mark (sometimes, simply called "end mark") disposed at the end portion thereof. The near end mark is detected with a sensor to stop running of the thermal transfer recording medium in a thermal printer, thereby preventing a so-called blind striking wherein printing is conducted in a portion of the recording medium where the ink layer is absent. There is a demand for some timelag between the time at which the near end mark is detected with a sensor and the time at which the recording medium is actually stopped due to mechanisms of the printer or the like. Therefore, a near end mark is provided on the heat-meltable ink layer of the end portion of the recording medium, and, hence, printing is made possible even when the portion of the recording medium where the near end mark is present passes at the printing part of the printer.

Heretofore, it was known to form such a near end mark by applying onto the heat-meltable ink layer a white ink comprising a white pigment, a resin, a wax and a solvent, followed by drying (see JP, A, 60-76389, JP, A, 2-229072).

However, the use of a thermal transfer recording medium wherein the near end mark is formed with use of the white ink involves problems that the transferability of the heat-meltable ink layer is poor when thermal printing is conducted at the portion of the recording medium where the near end mark is present, and the white ink itself is poor in stability, resulting in a coating with poor surface quality.

In view of the aforesaid problems of the prior art, it is an object of the present invention to provide a process for producing a thermal transfer recording medium wherein a near end mark ink having good stability is used to form a near end mark with good surface quality and which provides a thermal transfer recording medium exerting good transferability even when printing is conducted at the portion where the near end mark is formed.

This and other object of the present invention become apparent from the description hereinafter.

SUMMARY OF THE INVENTION

The present invention provides a process for producing a thermal transfer recording medium having a near end mark, which comprises: applying a near end mark ink onto the uppermost heat-meltable ink layer of a thermal transfer recording medium and drying the resultant to form a near end mark, the near end mark ink being a white ink comprising a white pigment, a resin, a wax and a solvent, the white pigment comprising 40 to 60% by weight of the total amount of solid matters of the ink, the resin comprising at least one resin selected from the group consisting of terpene.phenol copolymer resin, phenol resin and polyethylene glycol resin, the wax comprising a particulate wax having an ester group and a melting point of not lower than 75° C., the solvent being capable of dissolving the resin and incapable of dissolving the particulate wax.

In an embodiment of the present invention, the near end mark has a sea-island structure wherein the particulate wax constitutes an island part and the resin constitutes a sea part.

In another embodiment of the present invention, the particulate wax of the white ink comprises at least one of carnauba wax or montan wax.

The present invention further provides a thermal transfer recording medium comprising a foundation, at least one heat-meltable ink layer provided on the foundation, and a near end mark provided on the uppermost heat-meltable ink layer, the near end mark comprising a white pigment, at least one resin selected from the group consisting of terpene.phenol copolymer resin, phenol resin and polyethylene glycol resin, and a particulate wax having an ester group and a melting point of not lower than 75° C., the white pigment comprising 40 to 60% by weight of the neat end mark, wherein the near end mark is formed by applying a near end mark ink onto the uppermost heat-meltable ink layer of the thermal transfer recording medium and drying the resultant, the near end mark ink being a white ink comprising the white pigment, the resin, the particulate wax and a solvent which is capable of dissolving the resin and incapable of dissolving the particulate wax.

DETAILED DESCRIPTION

Figure 1:
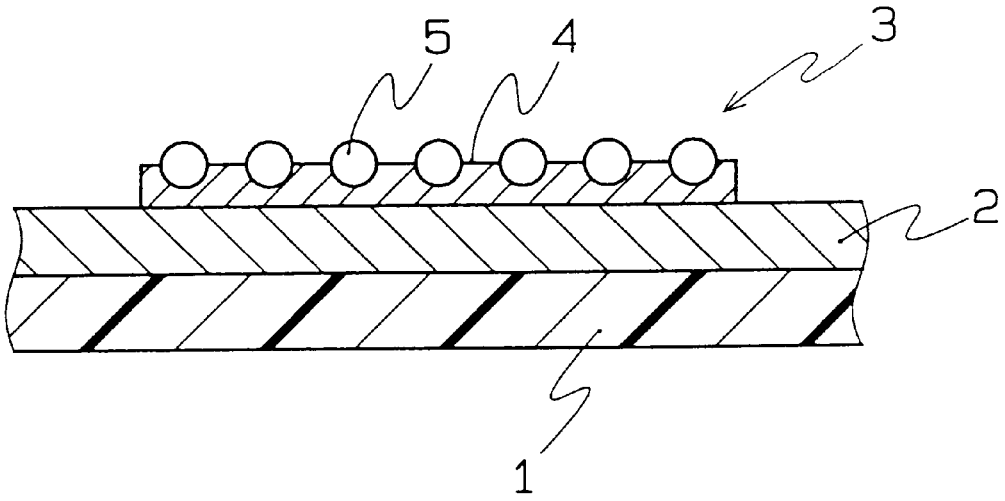
FIG. 1 is a schematic partial cross section showing an example of a thermal transfer recording medium produced by the process of the present invention.

The white ink for a near end mark usable in the present invention comprises a white pigment, at least one resin selected from the group consisting of terpene.phenol copolymer resin, phenol resin and polyethylene glycol resin, a particulate wax having an ester group and a melting point of not lower than 75° C. and a solvent which is capable of dissolving the resin and incapable of dissolving the particulate wax.

By virtue of using the aforesaid specific resin as the resin component, the white ink layer constituting the near end mark shows good cut-off property when thermal transfer printing is carried out at the portion of the recording medium where the near end mark is present, thereby resulting in clear printed images. Herein, the term "cut-off property" refers to the property wherein only a heated portion of the ink layer is separated from an unheated portion in the periphery of the heated portion and transferred, but the unheated portion is not transferred.

By virtue of using the aforesaid particulate wax having an ester group and a melting point of not lower than 75° C. as the wax component, the white ink is prevented from mixing with the colored ink of the heat-meltable ink layer because of relatively high melt viscosity of the wax when the near end mark portion of the recording medium is used for thermal transfer printing, resulting in printed images with a desired color. Further, since the wax shows good adhesion to a paper sheet, the white ink layer exhibits good transferability when the near end mark portion of the recording medium is used for thermal transfer printing, resulting in clear printed images.

By virture of using as the solvent the aforesaid solvent which is capable of dissolving the resin and incapable of the particulate wax, the white ink layer constituting the formed near end mark has a sea-island structure wherein the particulate wax constitutes an island part and the resin constitutes a sea part. The sea-island strauctcure of the white ink layer as the near end mark of which the island part comprises the particulate wax having a high melting point improves antiblocking property of the recording medium during storage and transferability of the white ink layer because particles for the island part are composed of the wax which is sharply melted upon heating.

The content of the white pigment is from 40 to 60% (% by weight, hereinafter the same) relative to the total amount of solid matters in the white ink. When the content of the white pigment is less than the above range, the resulting near end mark shows poor whiteness and, hence, sometimes the near end mark is not accurately detected. When the content of the white pigment is more than the above range, a phenomenon that a portion of the white ink applied onto a printing plate remains on the plate when the recording medium is printed with the white ink is prone to occur, resulting in failure to form a clear near end mark.

FIG. 1 is a schematic partial cross section showing an example of a thermal transfer recording medium with a near end mark produced by the process of the present invention.

In FIG. 1, numeral 1 denotes a support on which a heat-meltable ink layer 2 is formed. A near end mark 3 is formed on the heat-meltable ink layer 2. The near end mark 3 has a sea-island structure wherein the aforesaid resin constitutes a sea part 4 and the aforesaid particulate wax constitutes an island part 5.

The present invention will be explained in detail.

First the white ink for the near end mark will be explained. The ink comprises a white pigment, at least one resin selected from the group consisting of terpene.phenol copolymer resin, phenol resin and polyethylene glycol resin, a particulate wax having an ester wax and a melting point of not lower than 75° C. and a solvent which is capable of dissolving the resin and incapable of dissolving the particulate wax.

Examples of the waxes having an ester group and a melting point of not lower than 75° C. include carnauba wax, montan wax and sasol wax. Carnauba wax and/or montan wax is preferably used since they are readily available in a particulate form.

Preferably the particulate wax has an average particle size of 0.5 to 3.0 $\mu$m. When the average particle size is smaller than the above range, the resulting recording medium is prone to cause blocking. When the average particle size is larger than the above range, the recording medium is prone to exert poor thermal transferability at the near end mark portion.

Examples of the white pigments include titanium oxide, zinc oxide, aluminum powder, magnesium carbonate and calcium carbonate. These white pigments can be used either alone or in combination of two or more species thereof.

Solvents usable in the present invention are not limited to particular ones so long as they are capable of dissolving the resin and incapable of dissolving the wax. However, from the viewpoint of reduction of drying time, alcoholic solvents are preferably used. Examples of the alcoholic solvents include methanol, ethanol, isopropyl alcohol and n-butanol. These solvents can be used either alone or in combination of two or more species thereof.

In the white ink usable in the present invention, the proportion of the white pigment to the total amount of solid matters in the ink is from 40 to 60% as described above. The proportions of the resin and the particulate wax to the total amount of solid matters in the ink are preferably from 10 to 30% and from 10 to 50%, respectively. When the proportion of the resin is less than the above range, the resulting white ink layer has poor adhesion to the heat-meltable ink layer and is brittle, resulting in falling of the white ink layer. When the proportion of the resin is more than the above range, the blocking is prone to occur and the thermal transferability is prone to be deteriorated. When the proportion of the particulate wax is less than the above range, the blocking is prone to occur. When the proportion of the wax is more than the above range, the thermal transferability is prone to be deteriorated.

The white ink may be incorporated with an additive such as dispersing agent or antistatic agent, as required.

The white ink usable in the present invention can be prepared by adding the aforesaid ingredients to the aforesaid solvent, dispersing the mixture by means of a despa or the like, and further dispersing the mixture by means of a ball mill, a sand mill, an attritor or the like, by which the white pigment is uniformly dispersed, the resin is dissolved and the wax is dispersed till it becomes particles having a desired particle size.

The white ink is applied on a desired portion of the heat-meltable ink layer of the end portion of a thermal transfer recording medium and dried to form a near end mark. The drying is conducted within a temperature range at which the particulate form of the wax is not lost. The pattern of the near end mark is not particularly limited and any pattern conventionally used can be adopted. Examples of the patterns include a pattern wherein the white ink is applied solid on the entire area of a desired portion, in the longitudinal direction, of the end portion of the recording medium, another pattern wherein the white ink is applied on an edge of the end portion of the recording medium in the longitudinal direction and still another pattern wherein the white ink is applied on the end portion of the recording medium in a zebra pattern.

The coating amount (coating amount after drying, hereinafter the same) of the white ink is preferably from 0.5 to 3.0 g/m$^2$ from the viewpoint of ensuring desired whiteness and transferability.

The thermal transfer recording medium on which a near end mark is formed by using the white ink is not particularly limited.

For example, there are examplified a recording medium wherein a heat-meltable colored ink layer is provided on a support, a recording medium wherein a release layer is further provided between the support and the heat-meltable colored ink layer and a recording medium wherein a top-coat layer is further provided on the heat-meltable colored ink layer by applying a wax emulsion or the like from the viewpoint of improving transferability and preventing smearing. In the present invention, the term "heat-meltable ink layer" is intended to refer to a heat-meltable colored ink layer, a heat-meltable release layer, a heat-meltable top-coat layer, or the like.

The present invention will be more fully described by way of Examples and Comparative Examples thereof. It is to be understood that the present invention is not limited to these Examples, and various changes and modifications may be made in the invention without departing from the spirit and scope thereof.

Examples 1 to 5 and Comparative Examples 1 to 3

Each composition shown in Table 1 was dispersed by means of a despa and further dispersed by means of a ball mill to give a white ink.

The average particle size of wax particles in each white ink thus obtained is shown in Table 1. The average particle size of wax particles was measured with a laser particle size distribution measuring device, SALD-1100 made by Shimadzu Corporation.

Each white ink was visually observed with time and the stability thereof was evaluated according to the following criterion:

3—The ink is uniform even after 24 hours.

2—The ink is uniform even after 12 hours.

1—The pigment precipitates after 12 hours.

Then, each white ink was applied solid onto a heat-meltable colored ink layer in the vicinity of the end portion of a thermal transfer recording medium by a flexographic printing method and dried at 60° C. to form a near end mark. The coating amount of the white ink was 2.0 g/m$^2$.

As the thermal transfer recording medium there was used one wherein the heat-meltable colored ink of the following formula was applied on one side of a 6.0 μm-thick polyethylene terephthalate film by a hot melt coating method to give a heat-meltable colored ink layer with a coating amount of 4.0 g/m$^2$.

Heat-meltable colored ink

| Ingredient | Part by weight |
|---|---|
| Paraffin wax (m. p. 65° C.) | 50 |
| α-olefin-maleic anhydride copolymer | 8 |
| Carnauba wax | 12 |
| Paraffin wax (m. p. 68° C.) | 15 |
| Carbon black | 15 |
| Total | 100 |

With respect to each of the thermal transfer recording media on which the near end mark was formed, the surface uniformity of the near end mark and the transferability at the near end mark portion were evaluated by the following evaluation methods.

<Surface uniformity>

The near end mark was visually observed and the surface uniformity thereof was evaluated according to the following criterion:

3—The surface is uniform and there is no coating unevenness.

2—There is somewhat coating unevenness.

1—There is marked coating unevenness.

<Transferability>

Each of the thermal transfer recording media was used in a thermal printer (B-30 made by TEC Co., Ltd.) to print a receptor paper. The image obtained using the near end mark portion and the image obtained using a portion of the recording medium other than the near end mark portion were visually observed and the effect of the near end mark on the image obtained using the near end mark portion was evaluated according to the following criterion:

3—White is inconspicuous in the image.

2—The image looks somewhat whitish.

1—The image apparently looks white.

TABLE 1

| | Ex. 1 | Ex. 2 | Ex. 3 | Ex. 4 | Ex. 5 | Com. Ex. 1 | Com. Ex. 2 | Com Ex. 3 |
|---|---|---|---|---|---|---|---|---|
| Ink formula (%) | | | | | | | | |
| Terpene phenol resin*1 | 4 | | | 5 | | | | 5 |
| Phenol resin*2 | | 8 | | | 5 | 4 | | |
| Polyethylene glycol resin*3 | | | 3 | | | | 5 | |
| Montan wax*4 | 10 | | 12 | | 8 | | | |
| Carnauba wax*5 | | 10 | | 15 | | | 10 | 10 |
| Paraffin wax*6 | | | | | | 10 | | |
| Titanium oxide*7 | 15 | 15 | 13 | 18 | 22 | 15 | 32 | 15 |
| Dispersing agent*8 | 5 | 5 | 5 | 5 | 8 | 5 | 5 | 5 |
| Isopropyl alcohol | 66 | 62 | 67 | 57 | 57 | 66 | 48 | |
| Toluene | | | | | | | | 65 |
| Average particle size of wax particles in ink (μm) | 2 | 2 | 2 | 2 | 2 | 3 | 2 | Dis-solved |
| Content of titanium oxide in solid matter of ink | 48 | 43 | 43 | 45 | 58 | 48 | 65 | 47 |

*1YS Polyster T140 made by Yasuhara Chemical Co., Ltd.
*2Tamanol 100s made by Arakawa Chemical Industries, Ltd.
*3PEG 6000 made by Dai-ichi Kogyo Seiyaku Co., Ltd.
*4Melting point: 85° C.
*5Melting point: 82° C., powder
*6Melting point: 74.5° C.
*7R-820 made by Ishihara Sangyo Kaisha, Ltd.
*8Solution containing 40% of solid matter

TABLE 2

| | Ex. 1 | Ex. 2 | Ex. 3 | Ex. 4 | Ex. 5 | Com. Ex. 1 | Com. Ex. 2 | Com. Ex. 3 |
|---|---|---|---|---|---|---|---|---|
| Ink stability | 3 | 3 | 3 | 3 | 3 | 2 | 2 | 1 |
| Surface uniformity of coating | 3 | 3 | 3 | 3 | 3 | 1 | 1 | 1 |
| Transferability | 3 | 3 | 3 | 3 | 3 | 1 | 2 | 1 |

The process of the present invention provides a thermal transfer recording medium having a near end mark wherein the surface quality of the near end mark is good because it is formed using a near end mark white ink with good storage stability and which exerts good transferability in printing at the near end mark portion because of the specific composition and sea-island structure of the white ink layer as the near end mark.

In addition to the materials and ingredients used in the Examples, other materials and ingredients can be used in Examples as set forth in the specification to obtain substantially the same results.

What is claimed is:

1. A process for producing a thermal transfer recording medium having a near end mark, which comprises: applying a near end mark ink onto the uppermost heat-meltable ink layer of a thermal transfer recording medium and drying the resultant to form a near end mark, the near end mark ink being a white ink comprising a white pigment, a resin, a wax and a solvent, the white pigment comprising 40 to 60% by weight of the total amount of solid matters of the ink, the resin comprising at least one resin selected from the group consisting of terpene.phenol copolymer resin, phenol resin and polyethylene glycol resin, the wax comprising a particulate wax having an ester group and a melting point of not lower than 75° C., the solvent being capable of dissolving the resin and incapable of dissolving the particulate wax.

2. The process of claim 1, wherein the near end mark has a sea-island structure wherein the particulate wax constitutes an island part and the resin constitutes a sea part.

3. The process of claim 1, wherein the particulate wax of the white ink comprises at least one of carnauba wax or montan wax.

4. A thermal transfer recording medium comprising a foundation, at least one heat-meltable ink layer provided on the foundation, and a near end mark provided on the uppermost heat-meltable ink layer, the near end mark comprising a white pigment, at least one resin selected from the group consisting of terpene.phenol copolymer resin, phenol resin and polyethylene glycol resin, and a particulate wax having an ester group and a melting point of not lower than 75° C., the white pigment comprising 40 to 60% by weight of the neat end mark, wherein the near end mark is formed by applying a near end mark ink onto the uppermost heat-meltable ink layer of the thermal transfer recording medium and drying the resultant, the near end mark ink being a white ink comprising the white pigment, the resin, the particulate wax and a solvent which is capable of dissolving the resin and incapable of dissolving the particulate wax.

* * * * *

UNITED STATES PATENT AND TRADEMARK OFFICE

CERTIFICATE OF CORRECTION

PATENT NO. : 5,976,675

DATED : November 2, 1999

INVENTOR(S) : Tadimichi Yamano

It is certified that error appears in the above-identified patent and that said Letters Patent is hereby corrected as shown below:

Cover page, item [30] Foreign Application Priority Data insert -- Nov. 28, 1996 [JP] Japan 8-317890 --.
Cover page, item [57] Abstract, line 12; column 1, line 62; column 2, line 35; column 3, line 33; column 6, line 62; and column 7, line 12 delete "terpene.phenol" and substitute therefor -- terpene-phenol --.
Column 1, line 14 delete "of".
Column 1, line 21 after "to" insert -- the --.
Column 1, line 22 delete "of" and substitute therefor -- at --.
Column 1, line 25 delete "at".
Column 1, line 33 delete "with use of" and substitute therefor -- using --.
Column 1, line 34 delete "involves problems" and substitute therefor -- is problematic in --.
Column 1, line 47 delete "object" and substitute therefor --objects--.
Column 2, line 12 delete "terpene.phe-" and substitute therefor -- terpene-phe- --.
Column 2, line 16; and column 8, line 3 delete "neat" and substitute therefor --near--.
Column 2, line 33; column 3, line 55 and line 64; and column 4, line 15 delete "usable" and substitute therefor -- useful --.
Column 2, line 55 after first occurrence of "of" insert --the--.
Column 2, line 64 delete "virtue of".
Column 2, line 65 after second occurrence of "of" insert --dissolving--.
Column 3, line 2 delete "straucture" and substitute therefor --structure--.
Column 3, line 5 before "antiblocking" insert --the--.

UNITED STATES PATENT AND TRADEMARK OFFICE

CERTIFICATE OF CORRECTION

PATENT NO. : 5,976,675

DATED : November 2, 1999

INVENTOR(S) : Tadimichi Yamano

It is certified that error appears in the above-identified patent and that said Letters Patent is hereby corrected as shown below:

Column 3, line 6 after "and" insert -- the --.
Column 3, line 57 delete "from".
Column 3, line 58 delete "the viewpoint of reduction of" and substitute therefor -- to reduce --.
Column 4, line 5 after "in" insert -- the --.
Column 4, line 6 and line 9 after "range," delete "the".
Column 4, line 14 before "dispersing" insert -- a --.
Column 4, line 21 delete "till" and substitute therefor--until--.
Column 4, line 23 delete "on a" and substitute therefor -- onto the--.
Column 4, line 33 and line 36 delete "on" and substitute therefor -- onto --.
Column 4, line 40 delete "from the viewpoint of ensuring" and substitute therefor -- to achieve the --.
Column 4, line 45 delete "there are exemplified" and substitute therefor -- one can use --.
Column 4, line 51 delete "from the" and substitute therefor -- to improve --.
Column 4, line 52 delete "viewpoint of improving." Delete "preventing" and substitute therefor -- to prevent --.
Column 5, line 1 after "of" insert -- the --.
Column 5, line 7 delete "with" and substitute therefor --over--.
Column 5, line 20 delete "As the" and substitute therefor -- The --. Delete "there was used" and substitute therefor -used was--.

UNITED STATES PATENT AND TRADEMARK OFFICE

CERTIFICATE OF CORRECTION

PATENT NO. : 5,976,675

DATED : November 2, 1999

INVENTOR(S) : Tadimichi Yamano

It is certified that error appears in the above-identified patent and that said Letters Patent is hereby corrected as shown below:

Column 5, line 57 delete "print a" and substitute therefor -- print to --.
Column 6, line 49 delete "Examples" and substitute therefor -- the present invention--.

Signed and Sealed this

Tenth Day of April, 2001

Nicholas P. Godici

*Attest:*

NICHOLAS P. GODICI

*Attesting Officer*

*Acting Director of the United States Patent and Trademark Office*